US008191448B2

(12) United States Patent
Kuehnle et al.

(10) Patent No.: US 8,191,448 B2
(45) Date of Patent: Jun. 5, 2012

(54) CUTTING DEVICE FOR AN ENDLESS TUBE SYSTEM

(75) Inventors: Albrecht Kuehnle, Sattledorf (DE); Bernd Mueller, Goeggingen (DE); Thomas Hertfelder, Frankenhardt (DE); Rolf Daeuber, Braunsbach (DE); Steffen Groeber, Rosengarten (DE); Florian Stadelmann, Leutershausen (DE)

(73) Assignee: Robert Bosch GmbH, Stuttgart (DE)

( * ) Notice: Subject to any disclaimer, the term of this patent is extended or adjusted under 35 U.S.C. 154(b) by 307 days.

(21) Appl. No.: 12/466,932

(22) Filed: May 15, 2009

(65) Prior Publication Data

US 2009/0301280 A1 Dec. 10, 2009

(30) Foreign Application Priority Data

Jun. 5, 2008 (DE) ..... 10 2008 002 246

(51) Int. Cl.
*B26D 1/25* (2006.01)
*B26D 1/00* (2006.01)

(52) U.S. Cl. ..... 82/70.2; 82/46

(58) Field of Classification Search ..... 82/70.2, 82/46, 113, 128, 131; 83/570, 582, 583, 83/591, 649

See application file for complete search history.

(56) References Cited

U.S. PATENT DOCUMENTS

| | | | | |
|---|---|---|---|---|
| 3,078,749 | A * | 2/1963 | Maxner et al. | 82/128 |
| 3,911,556 | A * | 10/1975 | Pierce | 29/558 |
| 3,911,557 | A * | 10/1975 | Pierce | 29/565 |
| 6,796,211 | B1 * | 9/2004 | Braunberger | 83/745 |
| 7,377,203 | B2 * | 5/2008 | Chomik | 83/582 |
| 2005/0139047 | A1 * | 6/2005 | Chen et al. | 82/101 |
| 2009/0228140 | A1 * | 9/2009 | Honegger et al. | 700/230 |

* cited by examiner

*Primary Examiner* — Will Fridie, Jr.
(74) *Attorney, Agent, or Firm* — Ronald E. Greigg

(57) ABSTRACT

The invention relates to a cutting device for a film of an endless web, which includes at least one blade for severing the film. A blade holder which receives and fixes the blade thereto is disposed on a base ring. The base ring in turn, is rotatably supported on a flange element. The blade is disposed in the blade holder in such a way that upon a rotation of the base ring, severing of the film by the blade is effected.

20 Claims, 3 Drawing Sheets

CUTTING DEVICE FOR AN ENDLESS TUBE SYSTEM

CROSS-REFERENCE TO RELATED APPLICATION

This application is based on German Patent Application 10 2008 002 246.2 filed Jun. 5, 2008.

BACKGROUND OF THE INVENTION

1. Field of the Invention

The present invention relates to a cutting device for a film of an endless tube system and to an isolation device having such a cutting device.

2. Description of the Prior Art

In so-called isolation devices, in which toxic or sterile materials, in particular, are handled in a closed chamber, it is necessary that objects or waste be ejected without contamination, for instance upon batch changes or the like. In particular, this requires that increased user protection be assured. One such gate is known for instance from German Utility Model DE 203 08 805 U1. This known gate includes a cylindrical hollow body, on the outer circumference of which an endless film tube is provided. The known device furthermore has a film welding device, with which the film tube can be welded before and after being filled with contaminated waste or the like. However, in this known device there is the danger that, for instance after cleaning the isolation device with water, contaminated residual drops will remain in the gate. Moreover, the moisture introduced by the cleaning process causes problems in torch cutting of the film tube. In unfavorable situations, a weld seam of reduced quality may be produced, and as a result a user and the environment may undesirably become contaminated. The film tube, which is then doubly welded at its beginning and end, is then cut off by means of a separate cutting device, in particular scissors or the like, at the welded portion of the tube. However, the danger exists that the weld seam will be mistake, allowing environmental contamination to occur.

ADVANTAGES AND SUMMARY OF THE INVENTION

The cutting device according to the invention has the advantage over the prior art that it makes safe, reliable severing of a closed film region from an endless tube film possible. The cutting device includes at least one blade for severing the film, a blade receptacle that receives and fixes the blade, a base ring on which the blade receptacle is disposed, and a flange element on which the base ring is rotatably supported. The blade is disposed in the blade receptacle in such a way that upon a rotation of the base ring, the blade is guided along an outer circumference of the endless film and in the process cuts into the film. Once the base ring has been rotated a single time by 360°, a film package is completely cut off from the endless film. Thus in the invention, a film bag, sealed off for instance by means of two weld seams, can be safely and quickly removed above the weld seam.

To achieve a clearly defined cutting operation, the base ring is preferably disposed horizontally.

In a further preferred feature of the invention, the blade is releasably disposed on the blade receptacle. As a result, after a closed film bag has been cut off, it is possible to remove the blade from its receptacle again, thus reliably precluding damage to the film by mistake, for instance when a section of film is pulled out to form a new bag. Preferably, a detent connection is provided for securing the blade on the blade receptacle.

The cutting device of the invention also preferably includes a spring element, which is disposed on the blade receptacle and which prestresses the blade in the direction of the film tube to be cut off. The spring element assures that the blade always comes securely into contact with the film and that a clean cutting operation will be performed.

Also preferably, the cutting device includes at least one handle, which is disposed on the base ring. By means of the handle, the base ring can be rotated manually, so that a cutting operation can be performed. Especially preferably, a plurality of handles along the circumference of the base ring are provided, so that a 360° rotation of the base ring can be done without the user's having to change his position.

To enable simple, secure support of the base ring, an encompassing groove is preferably embodied in the flange element. The base ring is supported in the groove. This can be accomplished especially preferably by means of a plurality of roller elements that run in the groove. As a result, there will be only slight resistance at the base ring when it rotates.

The present invention furthermore relates to an isolation device having a cutting device according to the invention. The cutting device of the invention is preferably disposed in a cylindrical hollow body on the outer circumference of which the endless tube is disposed. A preferably inflatable seal is provided on the outside of the hollow body, so that the film extends between the seal and the hollow body. The inflatable seal is especially preferably provided in a separate groove in the flange element of the cutting device. This arrangement has the advantage in particular that the cutting device can be disposed above the inflatable seal, so that it can be assured that there is no contamination of the tube in the region where the tube will be cut off. Before the actual cutting operation, the inflatable seal is preferably inflated, so that the film is pressed against the cylindrical hollow body by the inflated seal. Also preferably, an engagement groove is formed in the cylindrical hollow body, and the blade protrudes into this groove during the cutting operation, making a contactless cutting operation possible. Alternatively, the hollow element can also be disposed relative to the blade in such a way that the blade touches the hollow element and cuts directly on the hollow element. To avoid damage, an insert or the like may be provided on the hollow element.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

A cutting device 1 in a first exemplary embodiment of the invention will be described in detail below in conjunction with FIGS. 1 through 3.

Figure 1:
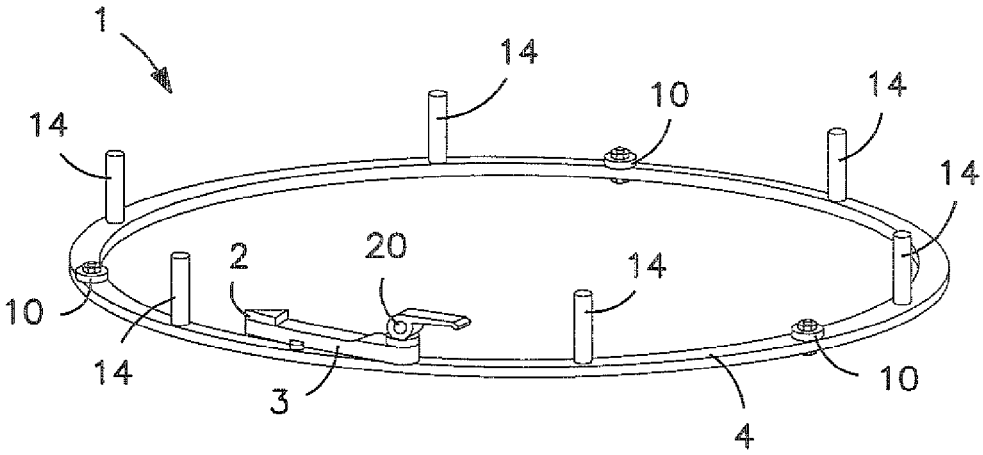
FIG. 1 is a schematic perspective view of a base ring of a cutting device in a first exemplary embodiment of the invention.

FIG. 1 schematically shows a perspective view of a base ring of cutting device 1 in the first exemplary embodiment. The cutting device 1 includes a blade holder 3, in which a blade 2 for cutting film open is disposed. The blade 2 is oriented toward the inside of the cutting device. The cutting device 1 further includes a base ring 4, on which the blade holder 3 is fixed. A plurality of handles 14 is disposed on the base ring 4, protruding from the base ring 4 at a right angle. Three rollers 10 are also disposed on the base ring 4 and enable rotatable support of the base ring 4.

The blade 2 can be fixed on the blade holder 3 and removed from the blade holder 3 by means of an eccentric clamping device 20. As a result, easy, fast replacement of the blade 2 can be made possible.

Figure 2:
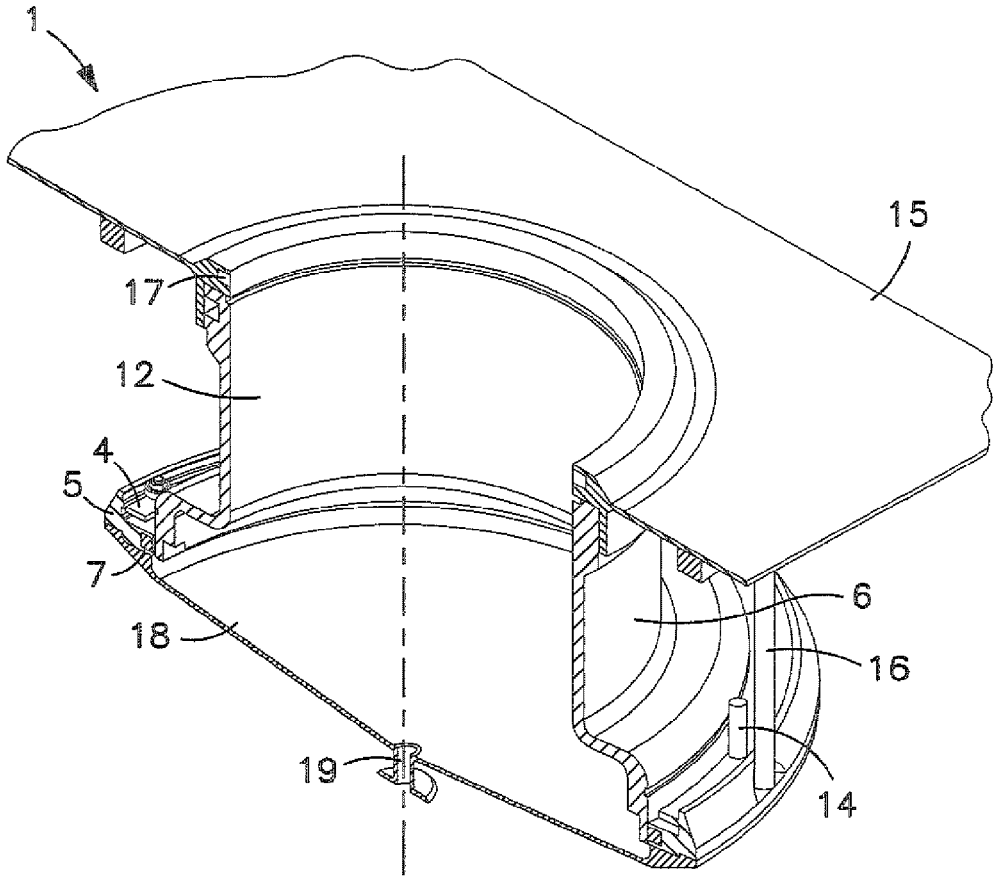
FIG. 2 is a sectional view of the cutting device shown in FIG. 1, in an installed state on an isolator.
Figure 3:
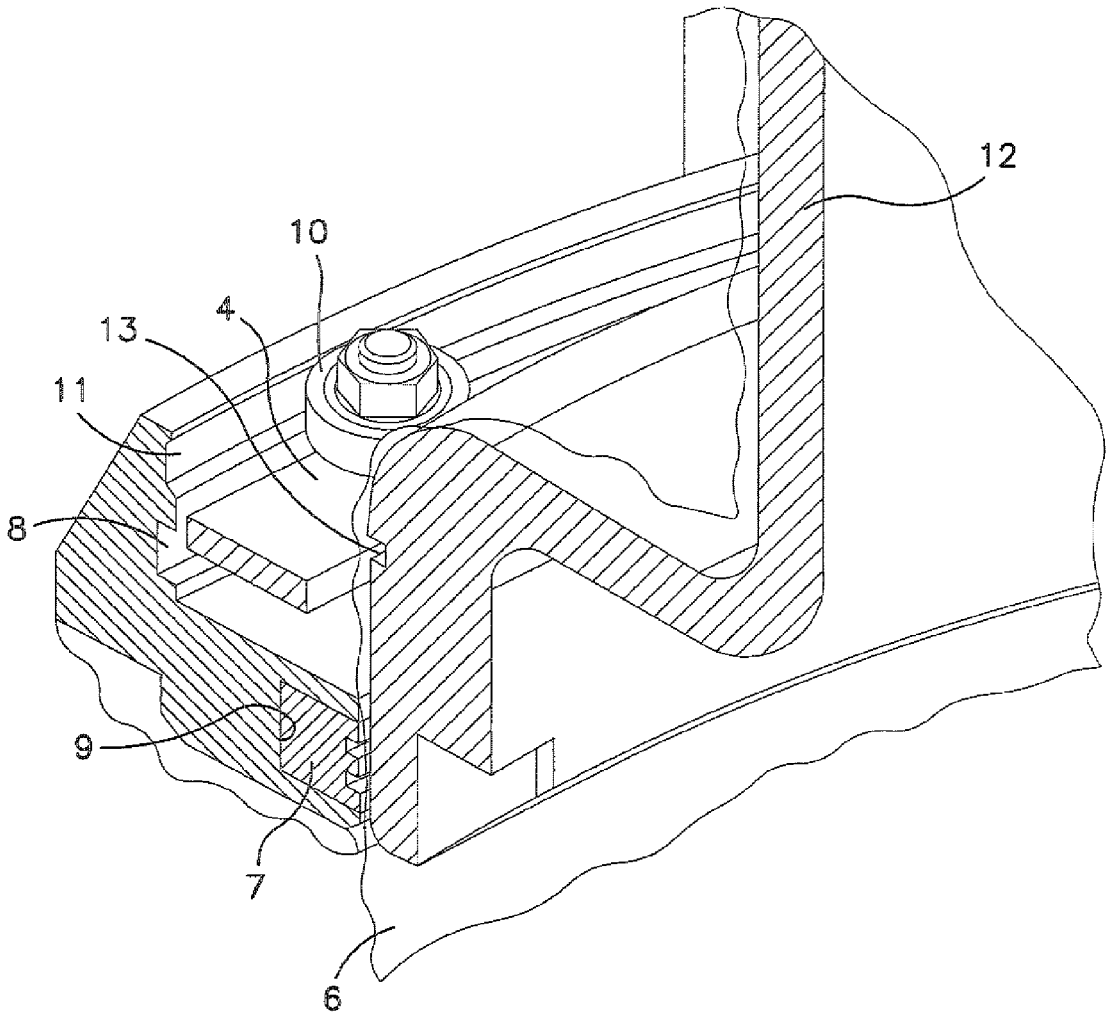
FIG. 3 is an enlarged detail of FIG. 2.

As can also be seen from FIGS. 2 and 3, the cutting device 1 further includes an annular flange element 5 (not enumerated in FIG. 3), which is disposed radially outside the base ring 4. The flange element 5 is disposed in stationary fashion, and the base ring 4 is supported rotatably with the three rollers 10 in a third groove 11 (FIG. 3) in the flange element 5. An encompassing first groove 8 is also provided in the flange element 5, and an outer circumference of the base ring 4 protrudes into this groove. The flange element 5 furthermore includes a second groove 9, in which an inflatable seal 7 is disposed. In the installed state, the flange element 5 is secured to a base 15 of an isolator by means of a plurality of vertical struts 16. In the base 15 of the isolator, an opening is formed at which a cylindrical hollow element 12 is disposed on the outside of which an endless film 6 is disposed. Through the cylindrical hollow element 12, it is possible for waste or cleaning water or the like to be ejected from the isolator, since these waste products are tightly closed off in a bag made from the endless film 6.

In FIG. 2, the cylindrical hollow element 12 is sealed by means of a cap 18, on which an outlet 19 that can be opened and closed is provided. The cap 18 is fixed on the outer circumference of the flange element 5, for instance by means of a thread or a bayonet mount.

An upper inflatable seal 17 is also provided on the end of the cylindrical hollow element 12 oriented toward the isolator, and at this seal, an inner cap, not shown, that is supported in the interior of the isolator can be sealed off. A film welding device, not shown, is also provided, which is capable of welding open ends of the endless film 6 in order to make a bag. The film welding device is disposed outside the isolator.

As can be seen particularly from FIG. 3, an encompassing engagement groove 13 for the blade 2 is provided in the cylindrical hollow element 12. The endless film 6 is disposed between the cylindrical hollow element 12 and the base ring 4, so that the blade 2 cuts into the endless film 6 from the outside inward. The blade 2 protrudes somewhat into the engagement groove 13, to make it possible to sever the endless film safely. It should be noted that alternatively, instead of the engagement groove 13, the blade 2 can also cut directly in an outer jacket region of the cylindrical hollow element 12; to avoid damage to the cylindrical hollow element 12, an especially embodied cutting jacket face may then for instance be provided.

Now if waste from the isolator, for instance, is to be ejected without causing contamination to the environment or a user, this can be done by way of the film gate described above. First, depending on the size of a bag to be produced, the endless film 6 is drawn downward and welded together at the open end by means of the welding device, not shown, creating a sacklike end of the endless film. In the welding, care must be taken to assure that the seam created is tight. The waste to be removed from the isolator is then placed in the sacklike end of the endless tube in the film gate. To that end, the inner cap, which until now has closed the cylindrical hollow element 12 at the seal 17, is removed by means of a glove mechanism and set aside in the interior of the isolator. Care must be taken that the endless film 6 not be damaged by the waste, for instance by sharp edges or corners. Before the waste is placed in the sacklike endless tube that is created, the inflatable seal 7 is activated, so that the seal 7 presses the endless film 6 from outside against the cylindrical hollow element 12.

Once the waste has been placed in the sacklike endless tube, the endless film 6 is drawn downward manually far enough from the cylindrical hollow element 12 that the film tube can be welded above the waste that is to be ejected. The inflatable seal 7 has been deactivated beforehand, to make it possible to pull the endless film 6 out.

Next, the inner cap is placed back on the cylindrical hollow element 12 and sealed off by means of the upper inflatable seal 17. Next, the waste-filled film tube is cut with a torch above the waste by a certain width, so that the bag can then be severed at the torch-cut region approximately in the middle of the weld seam, so that a new sacklike end region of the film is immediately created again. Waste can thus easily be ejected from the isolator.

If a new batch is to be processed in the isolator, then to avoid contamination the film tube must also be cleaned. To that end, in a first step, the lower cap 18 is placed on the flange element 5. Then, as described above, the endless film 6, already embodied as a film sack, is severed above the inflatable seal 7 by means of the cutting device 1 of the invention. Since severing is done above the inflatable seal 7, it can be assured that there is no contamination of the endless film 6 that is still located on the outer circumference of the cylindrical hollow element 12.

After the severing, the cut-off film sack from the film gate is moved into the interior of the isolator and set down there. This can be done for instance with known glove mechanisms, which are disposed on the isolator and with which a user can perform manipulations inside the isolator. The lower cap 18 stays in place. Cleaning of the film gate and isolator then takes place, the lower cap 18 continuing to remain in place. Any contaminated cleaning fluid that may occur can then be carried away via the outlet 19. Next, the inner cap from the interior of the isolator is placed on the upper inflatable seal 17 and sealed off. The lower cap 18 is then taken off, and film 6 from the endless film is pulled out past the free outward-oriented end region of the cylindrical hollow element 12 and welded. As a result, an endless film sack has once again been created. The upper cap is then removed again, and the film, resulting from the operation of cleaning the film gate, that was previously placed in the isolator is placed in the endless sack, and then the endless film is pulled out farther as described above and torch-cut again and then severed manually. As a result, cleaning of the film gate and disposal of possibly contaminated film residues from the film gate have been attained.

The cutting device 1 of the invention assures that exact severing of the endless film 6 can be done above the inflatable seal 7, thus preventing any contamination whatever of the endless film 6. Thus according to the invention, maximum user protection can be attained, since the film gate can also be cleaned and any contaminated film can be disposed of, without problems, if a change of batches or the like is done in the isolator. Severing above the inflatable seal 7 by means of the cutting device 1 of the invention assures that no excess contaminated residual film will remain in the interior region that is to be cleaned in the film gate. Since the cutting device 1 is securely supported in the flange element 5 via the base ring 4 and the three rollers 10, a safe cut at the film can be attained by rotating the base ring 4 using the handles 14. It should be noted in this regard that it is understood that a plurality of blades may also be provided on the base ring 4, so that instead of a 360° rotation of the base ring 4, only a 180° rotation, for instance, has to be executed, if two diametrically opposed blades are provided. Once the film has been cut off, to avoid damage to the endless film 6 during further manipulation of the film gate to eject waste, the blade 2 is disposed removably and can then simply be taken off after the cutting operation.

In this respect it should be noted that it is also possible for the blade holder 3 to be designed for instance such that it can assume a first position, in which a cut is done with the blade, and a second position, in which the blade is removed from the film and disposed in a safe position of repose. To avoid user mistakes, however, it is preferable that the blade be designed removably. It should also be noted that it is understood that the entire blade holder 3 together with the blade 2 may also be disposed removably.

Figure 4:
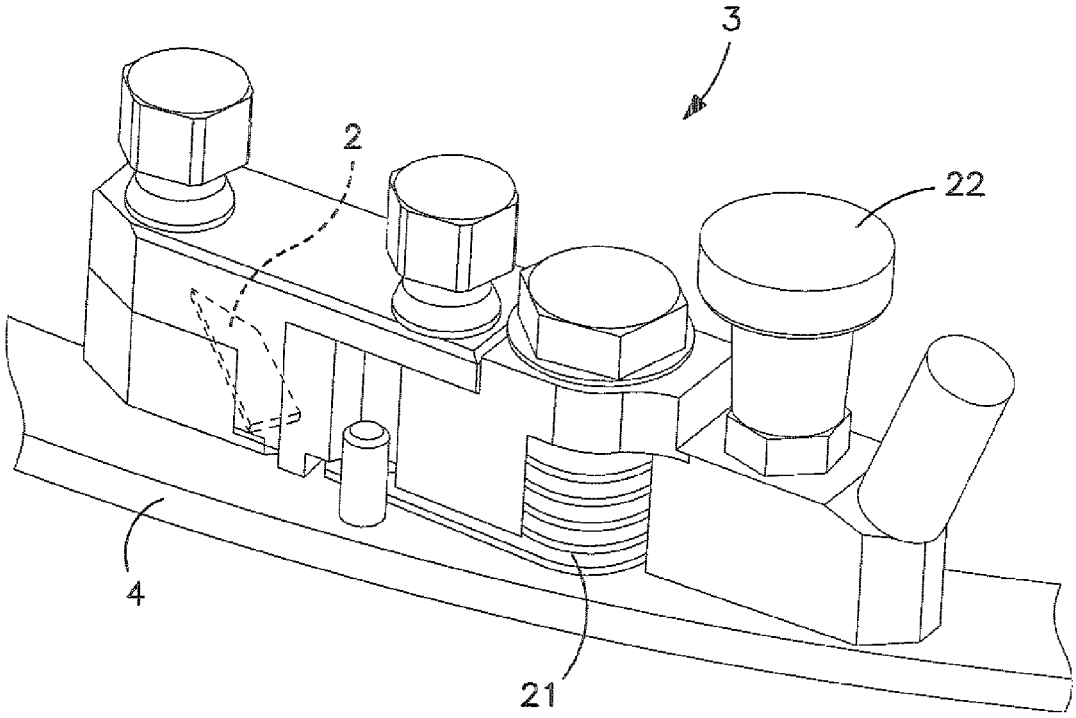
FIG. 4 is a perspective view of a blade holder for a cutting device in a second exemplary embodiment of the invention.

FIG. 4 shows a cutting device in a second exemplary embodiment, in which parts that are the same or functionally the same are identified by the same reference numerals as in the first exemplary embodiment.

The cutting device of the second exemplary embodiment is essentially equivalent to the first exemplary embodiment, but in a distinction from the latter, the blade holder 3 is embodied differently. As can be seen from FIG. 4, the blade holder 3 includes a spring element 21, which prestresses the blade holder 3, along with the blade 2 retained on it, in an inward-oriented direction. A spring constant of the spring element 21 is relatively large, to assure a relatively high rigidity of the blade holder 3 during the cutting operation done with the blade. As shown in FIG. 4, the blade holder 3 can easily be removed from the base ring 4 by means of a fast-action closure 22. Otherwise, this exemplary embodiment is equivalent to the preceding exemplary embodiment, so that the description of the latter can be referred to.

The foregoing relates to preferred exemplary embodiments of the invention, it being understood that other variants and embodiments thereof are possible within the spirit and scope of the invention, the latter being defined by the appended claims.

We claim:

1. A cutting device for a film of an endless web of film, comprising:

at least one blade for severing the film;

a blade holder for receiving and fixing the blade thereto;

a base ring, on which the blade holder is disposed; and a flange element secured in stationary fashion to a base, the base ring supported rotatably in the flange element so that the base ring rotates relative to the flange element, wherein the flange element encompasses the base ring, and wherein the blade is disposed in the blade holder in such a way that upon a rotation of the base ring, severing of the film by means of the blade is effected.

2. The cutting device as defined by claim 1, wherein the base ring is disposed horizontally.

3. The cutting device as defined by claim 1, wherein the blade is disposed releasably on the blade holder.

4. The cutting device as defined by claim 2, wherein the blade is disposed releasably on the blade holder.

5. The cutting device as defined by claim 3, wherein the blade is secured to the blade holder by means of a detent connection.

6. The cutting device as defined by claim 4, wherein the blade is secured to the blade holder by means of a detent connection.

7. A cutting device for a film of an endless web of film, comprising:

at least one blade for severing the film;

a blade holder for receiving and fixing the blade thereto;

a base ring, on which the blade holder is disposed;

a flange element, on which the base ring is rotatably supported, wherein the blade is disposed in the blade holder in such a way that upon a rotation of the base ring, severing of the film by means of the blade is effected; and a spring element, which is disposed on the blade holder and which prestresses the blade holder in a direction of the film that is to be severed.

8. A cutting device for a film of an endless web of film, comprising:

at least one blade for severing the film;

a blade holder for receiving and fixing the blade thereto, wherein the blade is disposed releasably on the blade holder;

a base ring, on which the blade holder is disposed;

a flange element, on which the base ring is rotatably supported, wherein the blade is disposed in the blade holder in such a way that upon a rotation of the base ring, severing of the film by means of the blade is effected; and a spring element, which is disposed on the blade holder and which prestresses the blade holder in a direction of the film that is to be severed.

9. A cutting device for a film of an endless web of film, comprising:

at least one blade for severing the film;

a blade holder for receiving and fixing the blade thereto;

a base ring, on which the blade holder is disposed;

a flange element, on which the base ring is rotatably supported, wherein the blade is disposed in the blade holder in such a way that upon a rotation of the base ring, severing of the film by means of the blade is effected; and at least one handle, which is disposed on the base ring and which enables manual rotation of the base ring.

10. A cutting device for a film of an endless web of film, comprising:

at least one blade for severing the film;

a blade holder for receiving and fixing the blade thereto;

a base ring, on which the blade holder is disposed, wherein the base ring is disposed horizontally;

a flange element, on which the base ring is rotatably supported, wherein the blade is disposed in the blade holder in such a way that upon a rotation of the base ring, severing of the film by means of the blade is effected; and at least one handle, which is disposed on the base ring and which enables manual rotation of the base ring.

11. A cutting device for a film of an endless web of film, comprising:

at least one blade for severing the film;

a blade holder for receiving and fixing the blade thereto, wherein the blade is disposed releasably on the blade holder;

a base ring, on which the blade holder is disposed;

a flange element, on which the base ring is rotatably supported, wherein the blade is disposed in the blade holder in such a way that upon a rotation of the base ring, severing of the film by means of the blade is effected; and at least one handle, which is disposed on the base ring and which enables manual rotation of the base ring.

12. The cutting device as defined by claim 1, wherein an encompassing groove, in which the base ring is supported, is embodied in the flange element.

13. The cutting device as defined by claim 2, wherein an encompassing groove, in which the base ring is supported, is embodied in the flange element.

14. The cutting device as defined by claim 4, wherein an encompassing groove, in which the base ring is supported, is embodied in the flange element.

15. A cutting device for a film of an endless web of film, comprising:

at least one blade for severing the film;

a blade holder for receiving and fixing the blade thereto;

a base ring, on which the blade holder is disposed;

a flange element, on which the base ring is rotatably supported, wherein the blade is disposed in the blade holder in such a way that upon a rotation of the base ring, severing of the film by means of the blade is effected; and an inflatable seal, which is disposed in a groove on the flange element.

16. A cutting device for a film of an endless web of film, comprising:

at least one blade for severing the film;

a blade holder for receiving and fixing the blade thereto, wherein the blade is disposed releasably on the blade holder;

a base ring, on which the blade holder is disposed;

a flange element, on which the base ring is rotatably supported, wherein the blade is disposed in the blade holder in such a way that upon a rotation of the base ring, severing of the film by means of the blade is effected; and an inflatable seal, which is disposed in a groove on the flange element.

17. The cutting device as defined by claim 15, wherein the base ring is disposed above the inflatable seal.

18. The cutting device as defined by claim 16, wherein the base ring is disposed above the inflatable seal.

19. A film gate for an isolation device, having a cylindrical hollow element on the outer circumference of which an endless film is disposed, including a cutting device comprising:

at least one blade for severing the film;

a blade holder for receiving and fixing the blade thereto;

a base ring, on which the blade holder is disposed; and a flange element, on which the base ring is rotatably supported, wherein the blade is disposed in the blade holder in such a way that upon a rotation of the base ring, severing of the film by means of the blade is effected.

20. The film gate for an isolation device according to claim 19, wherein the blade is disposed releasably on the blade holder.

* * * * *